US009425534B2

(12) United States Patent
Schmidt et al.

(10) Patent No.: US 9,425,534 B2
(45) Date of Patent: Aug. 23, 2016

(54) LEVER-TYPE ELECTRICAL CONNECTOR WITH CONNECTOR POSITIONING ASSURANCE MEMBER

(71) Applicant: Delphi International Operations Luxembourg, S.A.R.L., Bascharage (LU)

(72) Inventors: Rainer Schmidt, Nuremberg (DE); Klaus Mueller, Insingen (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 0 days.

(21) Appl. No.: 14/852,974

(22) Filed: Sep. 14, 2015

(65) Prior Publication Data

US 2016/0118741 A1 Apr. 28, 2016

(30) Foreign Application Priority Data

Oct. 27, 2014 (EP) ..... 14190516

(51) Int. Cl.

| | |
|---|---|
| ***H01R 13/627*** | (2006.01) |
| ***H01R 13/44*** | (2006.01) |
| ***H01R 13/10*** | (2006.01) |
| ***H01R 13/52*** | (2006.01) |
| ***H01R 13/639*** | (2006.01) |

(52) U.S. Cl.

CPC ..... *H01R 13/44* (2013.01); *H01R 13/10* (2013.01); *H01R 13/521* (2013.01); *H01R 13/6272* (2013.01); *H01R 13/639* (2013.01)

(58) Field of Classification Search

CPC ..... H01R 13/6271; H01R 13/6275
USPC ..... 439/352, 489
See application file for complete search history.

(56) References Cited

U.S. PATENT DOCUMENTS

| | | | | |
|---|---|---|---|---|
| 6,312,277 | B1 * | 11/2001 | Holub | H01R 13/6272 439/352 |
| 6,435,895 | B1 * | 8/2002 | Fink | H01R 13/6272 439/352 |
| 8,016,606 | B1 * | 9/2011 | Kwan | H01R 13/641 439/352 |
| 2010/0035459 | A1 * | 2/2010 | Briant | H01R 13/6275 439/352 |
| 2010/0112845 | A1 * | 5/2010 | Lam | H01R 13/6275 439/352 |

* cited by examiner

*Primary Examiner* — Phuong Dinh
(74) *Attorney, Agent, or Firm* — Robert J. Myers

(57) ABSTRACT

An electrical connector assembly includes a plug connector. The plug connector comprises a connector housing having a flexible leg. The plug connector further comprises a secondary locking device having a jamming portion and a flexible arm, which is in blocking contact with the flexible leg when the plug connector is not mated with a corresponding counter connector. The plug connector thereby allows for direct mating with a corresponding counter connector, whereby the secondary locking device provides connector position assurance (CPA) functionality.

12 Claims, 5 Drawing Sheets

LEVER-TYPE ELECTRICAL CONNECTOR WITH CONNECTOR POSITIONING ASSURANCE MEMBER

CROSS-REFERENCE TO RELATED APPLICATION

This application claims the benefit under 35 U.S.C. §119 (a) of patent application Ser. No. 14/190,516.6 filed in the European Patent Office (EPO) on Oct. 27, 2014, the entire disclosure of which is hereby incorporated by reference.

TECHNICAL FIELD OF THE INVENTION

The present invention relates to an electrical connector assembly with a secondary locking device, and in particular wherein the electrical connector assembly allows for direct mating and unmating of a plug connector to a corresponding counter connector.

BACKGROUND OF THE INVENTION

The safe coupling of connectors is of high importance for many applications. For example, modern passenger cars comprise a variety of different electrical connections. For ensuring that connectors mated with a corresponding counter connector cannot become loose unintentionally, secondary locking members are known in the art to guarantee a safe mechanical coupling between the connector and counter connector.

Further on, it is also desirable to indicate, either visually or physically, that a plug connector has been fully and properly mated with a corresponding counter connector during the assembly procedure for allowing a "fool proof" assembly. In order to reduce the risk associated with improperly mated connectors, so-called connector position assurance (CPA) devices have been developed. Such CPA devices are separate elements, which can be inserted into a connector housing of a plug connector and are often provided in a different color. When the connector is not properly or fully coupled to its corresponding counting connector, the CPA device cannot be fully inserted into the connector housing. Accordingly, the CPA device protrudes from the connector, indicating that full mating has not been accomplished yet. Only upon full and proper mating of the connector with the counter connector it is possibly to fully insert the CPA device into the connector housing. This allows to visually indicating whether the plug connector has been properly and correctly mated with the counter connector. Often, the functionalities of CPA devices and secondary locking devices are integrated in one part.

Accordingly, the commonly used mating procedure requires several steps. The connector has to be mated with a counter connector, and also locked thereto. Further, a secondary lock has to be closed and/or a CPA device has to be inserted to assure the proper mating. However, in modern manufacturing sites, it is often desired that a plug connector is mated with a counter connector in a fast and secure manner. This need arises among others for ergonomic reasons. Hence, it is desired that the mating procedure can be accomplished with a minimal number of steps.

The subject matter discussed in the background section should not be assumed to be prior art merely as a result of its mention in the background section. Similarly, a problem mentioned in the background section or associated with the subject matter of the background section should not be assumed to have been previously recognized in the prior art.

The subject matter in the background section merely represents different approaches, which in and of themselves may also be inventions.

BRIEF SUMMARY OF THE INVENTION

According to the present invention there is provided an electrical connector assembly, which comprises a plug connector. This plug connector comprises a connector housing having a flexible leg (i.e. one or more) with a primary locking device provided thereon. The primary locking device is adapted to provide a primary locking function when the plug connector is mated with a corresponding counter connector. The primary locking device is provided such that when the flexible leg of the connector housing is flexed, the primary locking function can be disengaged.

The plug connector further comprises a secondary locking device which is arranged moveable relative to the connector housing between an open position and a closed position. In the open position, it allows a mating of the plug connector with a counter connector and in the closed position it provides for an additional (secondary) locking between plug connector and counter connector. To this end, the secondary locking device comprises a flexible arm and at least one jamming portion. The jamming portion can be part of the flexible arm of the secondary locking device. Preferably, however, the jamming portion is an element which is separate from the flexible arm. This is advantageous, since it allows designing the jamming portion with a high rigidity and the flexible arm with a low rigidity, i.e. increased flexibility.

The flexible leg of the connector housing and the flexible arm of the secondary locking device are adapted to be in blocking contact when the flexible arm of the secondary locking device is not flexed. In other words: in the idle, not stressed or engaged configuration of the flexible arm the secondary locking device cannot be moved in the blocked direction, which preferably is the mating direction. This blocking contact inhibits in particular movement of the secondary locking device from the open position into the closed position. In other words, the flexible arm of the secondary locking device needs to be flexed in order to move the secondary locking device from the open position into the closed position. This has the advantage that an operator can push the plug connector into the mated position via the secondary locking device, e.g. by applying pressure onto the secondary locking device itself. Thereby, a so-called inertia locking functionality can be achieved.

Further on, the flexible arm of the secondary locking device is adapted to be flexed when the plug connector is mated with the corresponding counter connector. Accordingly, when the plug connector is mated with the counter connector, the flexible arm is flexed such that the secondary locking device can be moved into the closed position. Preferably, the arm is automatically flexed due to e.g. a (direct or indirect) contact with a portion of the counter connector. This is advantageous, since upon full mating, the secondary locking device is thus automatically released and can be pushed in its locked position.

When the secondary locking device is in the closed position, the jamming portion of the secondary locking device is adapted to prevent a flexing of the flexible leg of the connector housing. In other words, the primary locking function of the flexible leg of the connector housing cannot be disengaged when the secondary locking device is in the closed position, because the jamming portion prevents a flexing of the flexible leg which could otherwise disengaged the primary locking function. Thereby, a second locking is provided to the connector system.

Hence, the design of the electrical connector assembly according to the present invention allows for a straightforward mating process. Since the secondary locking device is released by pushing it in mating direction, the secondary locking device can be automatically closed in one single work step when mating the plug connector with the counter connector. The inertia involved in the mating process, when an operator pushes the plug connector via the secondary locking device with considerable force, has the effect that the secondary locking device is automatically closed by the operator, when the applied force is sufficient for mating. This particularity is also denoted as "inertia locking". The interaction of the secondary locking device with the connector housing thereby provides in addition a connector position assurance (CPA) functionality, allowing for a direct verification of a successful and complete mating.

The term "counter connector" used herein denotes any kind of connector adapted to connect to the plug connector. Furthermore, the terms "flexible leg" and "flexible arm" used herein are not limiting to a particular appearance or structure, however, both elements should not be stiff, i.e. rigid. For example, the flexible leg can be present in form of a plate-like element, while the flexible arm can be in the form of a ring-like structure instead. Preferably, the flexible leg and the flexible arm are of a rod-like or bar-like form, extending parallel to the mating direction.

As mentioned above, preferably, the direction of movement of the secondary locking device from the open position to the closed position is the same or approximately the same as the mating direction of the plug connector to the corresponding counter connector. Further preferred, the plug connector can be fully coupled to the corresponding counter connector by means of inertia locking. The skilled person understands that inertia locking implies that the whole coupling procedure is performed in one step, and the operator cannot stop at an intermediate coupling state. In other words, when starting the coupling procedure and overcoming a first barrier with a certain force, the coupling procedure is continued due to inertia until the plug connector is fully coupled to the corresponding counter connector. The term "fully coupled" thereby means that the plug connector is mated with the corresponding counter connector and the secondary locking device is in the closed position, thereby providing CPA functionality. Accordingly, due to the inventive design, it is possible to mate and unmate plug connector and corresponding counter connector in a direct and straightforward manner, requiring only a single action of the operator.

In a further preferred embodiment, the flexible arm of the secondary locking device comprises a T-shaped or L-shaped portion and the flexible leg of the connector housing comprises at least one projection. Preferably, when the plug connector is not mated with the corresponding counter connector, any forces acting in mating direction onto the secondary locking devices are transferred in longitudinal direction along the flexible arm, which is not flexed, onto the connector housing via the blocking contact between the T- or L-shaped portion and the projection. Accordingly, the interaction between the T- or L-shaped portion and the projection of the connector housing inhibits the movement of the secondary locking device from the open position into the closed position when the plug connector is not mated with the corresponding counter connector. Since the forces are transferred in longitudinal direction along the flexible arm, the flexible arm can withstand relatively high forces without being deformed or breaking.

In a further preferred embodiment, the secondary locking device comprises a release portion which is adapted to flex the flexible leg of the connector housing when a secondary locking device is moved from the closed position to the open position. Due to this flexing of the flexible leg, the primary locking function is disengaged and the plug connector can be unmated and removed from the corresponding counter connector.

In a further preferred embodiment, the connector housing comprises guiding means which guide the movement of the secondary locking device between the open and closed position. Preferably, the guiding means comprises a recess such that the secondary locking device can be rotated at least partially around an axis perpendicular to the mating direction. Due to this rotation, the secondary locking device interacts with the flexible leg of the connector housing such that the flexible leg is flexed and the primary locking function is disengaged. Accordingly, by rotating the secondary locking device, an operator can disengaged the primary locking function and unmate the plug connector from the corresponding counter connector with minimal effort.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

It is therefore an object of the present invention to provide an electrical connector assembly which allows for a fast and secure mating of a plug connector with a counter connector. It is an additional object of the present invention to provide an electrical connector assembly which allows for an easy unmating procedure without increasing the risk of an unwanted release of the connector from the counter connector.

Figure 1:
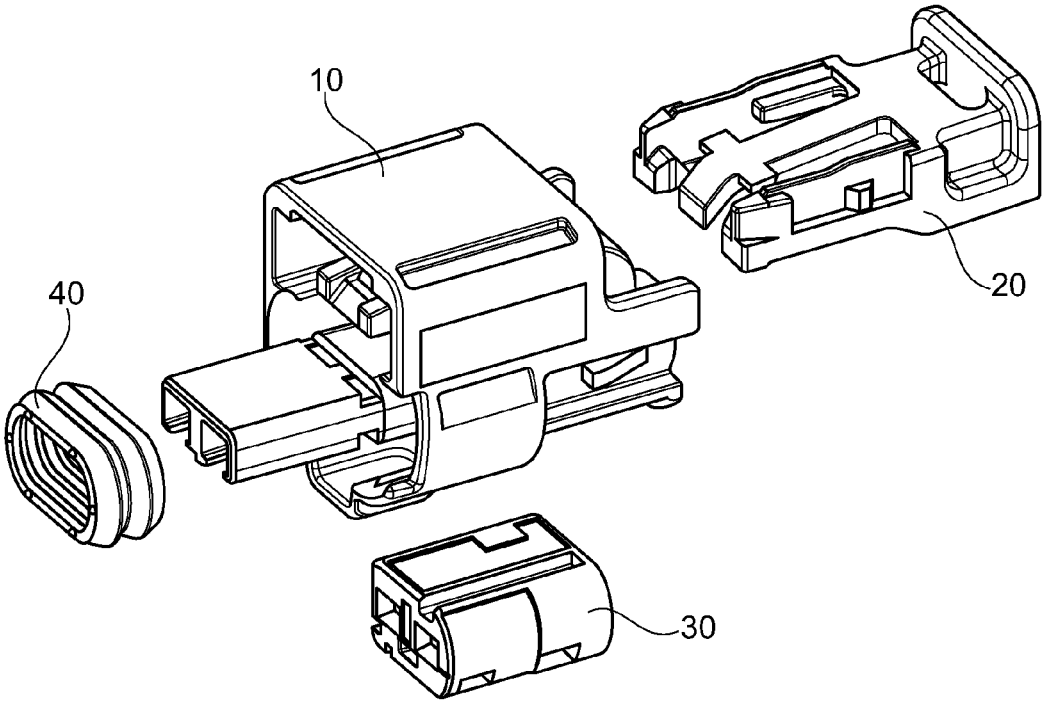
FIG. 1 illustrates a plug connector in a fully disassembled state according to one embodiment.
Figure 2:
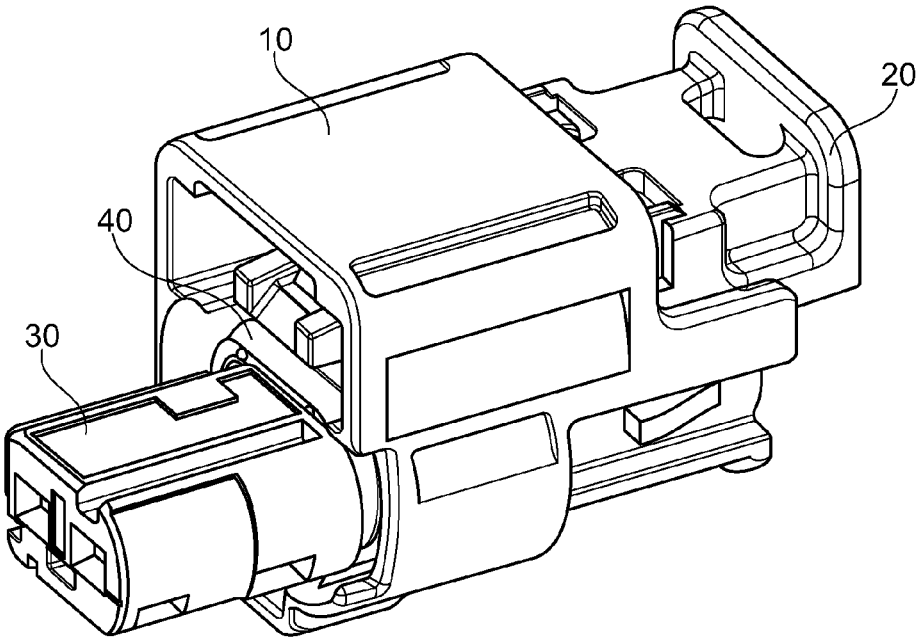
FIG. 2 illustrates the plug connector of FIG. 1 in a fully assembled state according to one embodiment.

FIG. 1 presents the components of a plug connector according to the present invention, namely a connector housing 10, a secondary locking device 20, a terminal position assurance (TPA) member 30, and a sealing member 40. FIG. 2 illustrates the plug connector of FIG. 1 in an assembled state. The skilled person understands that the TPA member 30 and sealing member 40 are optional components, which are preferably utilized in order to improve the functionality of the plug connector.

Figure 3:
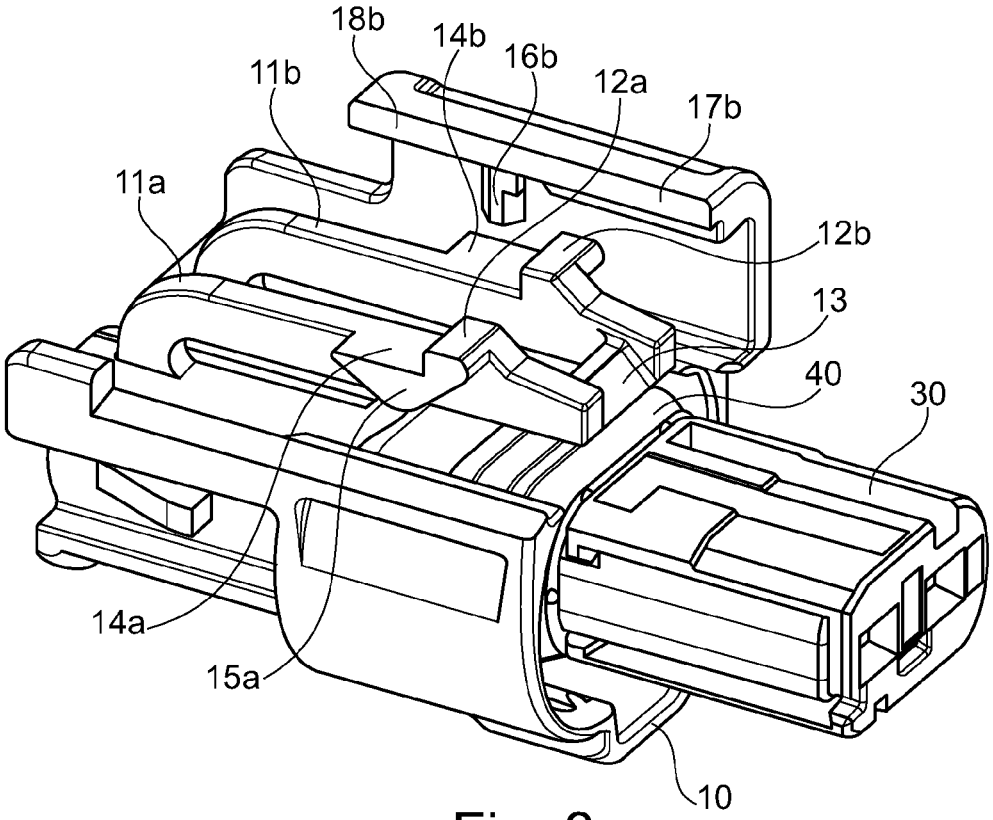
FIG. 3 illustrates a partially cut view of a partially assembled plug connector according to one embodiment.

FIG. 3 illustrates the connector housing 10 with TPA member 30 and sealing member 40 attached thereto. The connector housing 10 comprises two flexible legs 11*a*, 11*b*, which support a primary locking device 13, which in turn is present in form of a latch. The latch is adapted to interact with a corresponding counter connector 50 in order to lock the connector housing 10 thereto. The flexible legs 11*a*, 11*b* further comprise two projections 12*a*, 12*b* and jamming surfaces 14*a*, 14*b*. The projections 12*a*, 12*b* and jamming surfaces 14*a*, 14*b* are both provided on the same, upper side of the flexible legs 11*a*, 11*b*. Opposing the jamming surface 14*a*, there is provided an unlocking portion 15*a*. Although not visible, the skilled person understands that a similar unlocking portion is provided opposing the jamming surface 14*b* provided on flexible leg 11*b*, as the illustrated connector housing 10 (and also the secondary locking device 20) is mirror-symmetric.

Figure 4:
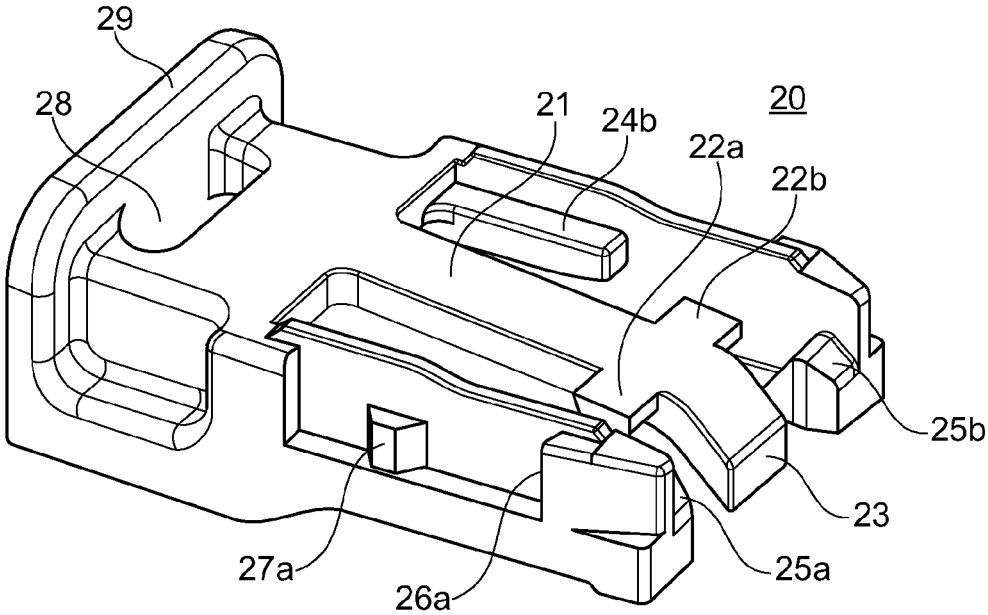
FIG. 4 illustrates a secondary locking device according to one embodiment.

FIG. 4 illustrates the secondary locking device 20 featuring a flexible arm 21, which in turn features a secondary locking means at one end thereof, which is adapted to interact with a corresponding counter connector 50. The skilled person understands that the secondary locking device 20 and also the connector housing 10 can have any number of flexible arms 21 and flexible legs 11, respectively.

The flexible arm 21 features a T-shaped portion 22*a*, 22*b* with lateral extensions away from the flexible arm 21. Alternatively, the flexible arm 21 could also be provided with an L-shaped portion, however, the T-shape allows due to its symmetric design a more homogenous transfer of forces. Further on, the secondary locking device 20 comprises two jamming portions, of which only one jamming portion 24*b* is visible in FIG. 4 due to the perspective. Further on, the secondary locking device 20 features two release portions 25*a*, 25*b* adapted to interact with the unlocking portions 15*a*, 15*b* of the connector housing 10 as will be described as follows.

The secondary locking device 20 is provided with a relatively large actuating surface 29, allowing for a simple operation. Further on, the secondary locking device 20 features an actuating portion 28, which allows for inserting for example a screw driver and moving the secondary locking device 20 therewith.

As can further be seen in FIG. 4, the secondary locking device 20 features at least one protrusion 26*a* adapted to interact with retention means, such as the retention means 16*b* (as mentioned, the secondary locking device 20 is symmetrical, so that it is in fact the symmetrical retention means opposite the retention means 16*b*), provided in form of a wedge on the connector housing 10, such that the secondary locking device 20 cannot be fully removed from the connector housing 10. It is generally preferred that the movement of the secondary locking device 20 is constrained to between an open and closed position, so that it cannot become unintentionally loose. Further on, the secondary locking device 20 features a feedback portion 27*a*, which passes by a respective retention means 16*a* provided on connector housing 10 (not visible in FIG. 4 due to the perspective, but analogous to retention means 16*b*) such that a portion of the secondary locking device 20 is deflected and subsequently attracted, thereby producing an acoustic feedback signal indicating that the mating process has succeeded.

Figure 5:
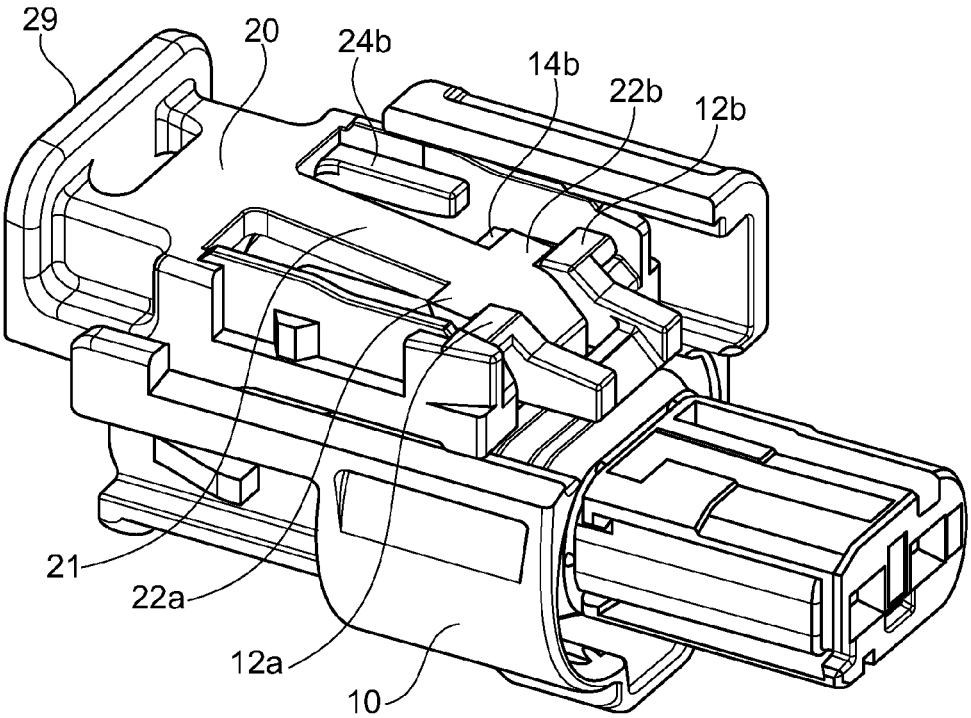
FIG. 5 illustrates a partially cut view of the plug connector of FIG. 2 according to one embodiment.

FIG. 5 illustrates the assembly of FIG. 3 with the secondary locking device 20 of FIG. 4 attached thereto, whereby the secondary locking device 20 is in its open position. The guiding means 17*b* of the connector housing 10 thereby restrict the direction of movement of the secondary locking device 20 to be approximately the same as the mating direction of the entire plug connector.

In the configuration of FIG. 5, the jamming surfaces 14*a*, 14*b* of the connector housing 10 are not covered by the jamming portions 24*b* of the secondary locking device 20. Further on, the blocking contact of the T-shaped portions 22*a*, 22*b* with the projections 12*a*, 12*b* of the connector housing 10 prevent a movement of the secondary locking device 20 further into the connector housing 10. In other words, when pushing on actuating surface 29, the resulting forces are transferred via the flexible arm 21 of the secondary locking device 20 in longitudinal direction of the flexible arm 21 to the T-shaped portion 22*a*, 22*b* and finally to the connector housing 10. Due to the symmetric arrangement of the T-shaped portion 22*a*, 22*b* and the orientation of the flexible arm 21, the forces are efficiently transferred without inducing damages to the secondary locking device 20.

Figure 6:
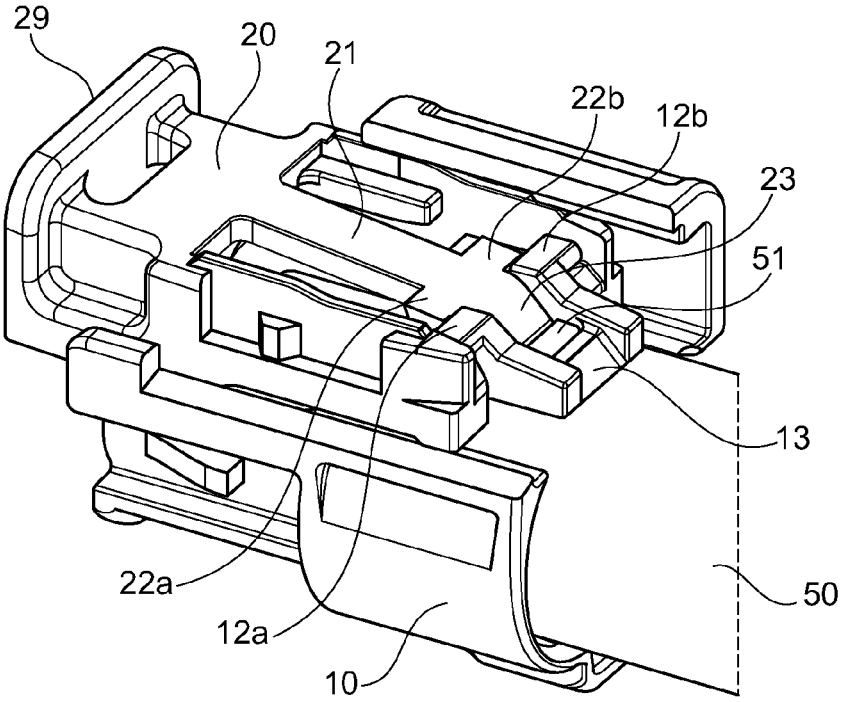
FIG. 6 illustrates a partially cut view of the plug connector of FIG. 2 mated with a corresponding counter connector according to one embodiment.

FIG. 6 shows the plug connector of FIG. 5, whereby the connector housing 10 is mated with the corresponding counter connector 50. During the mating procedure, a counter-locking means 51 provided on the counter connector 50, preferably being in form of a bulge, flexes the flexible legs 11*a*, 11*b* of the connector housing 10 such that the primary locking device 13 of the connector housing 10 can be positioned on the other side (behind) of the counter-locking means 51. The same counter-locking means 51 is adapted to interact with the secondary locking means 23 of the secondary locking device 20 such that the flexible arm 21 is flexed upwardly (in the orientation of FIG. 6) and the blocking contact present between the T-shaped portions 22*a*, 22*b* and projections 12*a*, 12*b* is cancelled, so that the secondary locking device 20 can now be further inserted into the connector housing 10, e.g. by pushing in mating direction onto actuating surface 29.

Figure 7:
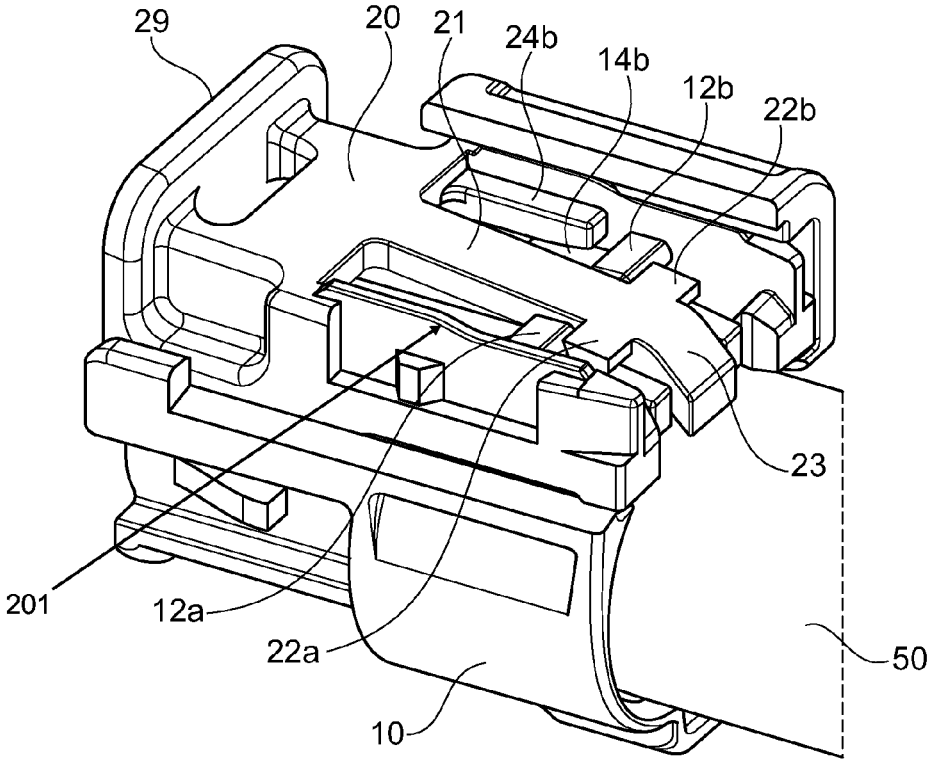
FIG. 7 illustrates a partially cut view of the plug connector of FIG. 6 fully coupled to the corresponding counter connector according to one embodiment.

FIG. 7 shows the plug connector of FIG. 6 fully coupled to the corresponding counter connector 50. As can be seen, the T-shaped portions 22*a*, 22*b* are now positioned behind the projections 12*a*, 12*b* of the connector housing 10 as seen in mating direction. Further on, the jamming portion 24*b* is now positioned such that it covers the jamming surface 14*b* of the flexible leg 11*b* of the connector housing 10 at least partially. Accordingly, since the jamming portion 24*b* is a rigid element, the flexible leg 11*b* of the connector housing 10 cannot be flexed. Hence, the full insertion of the secondary locking device 20 into connector housing 10, as illustrated in FIG. 7, indicates to the operator that (i) the connector housing 10 is mated with the corresponding counter connector 50, (ii) the primary locking device 13 of the connector housing 10 is properly positioned with respect to the counter-locking means 51 of counter connector 50 to provide primary locking function, (iii) the secondary locking means 23 is positioned to support the secondary locking functions, and (iv) the jamming portion 24*b* is arranged such that the primary locking function of the connector housing 10 cannot be disengaged. Further, one can see that a step 201 is provided on the guide walls of the secondary locking device 20. The step 201 facilitates the rotation of the secondary locking device 20 as will be explained in more detail below.

Figure 8:
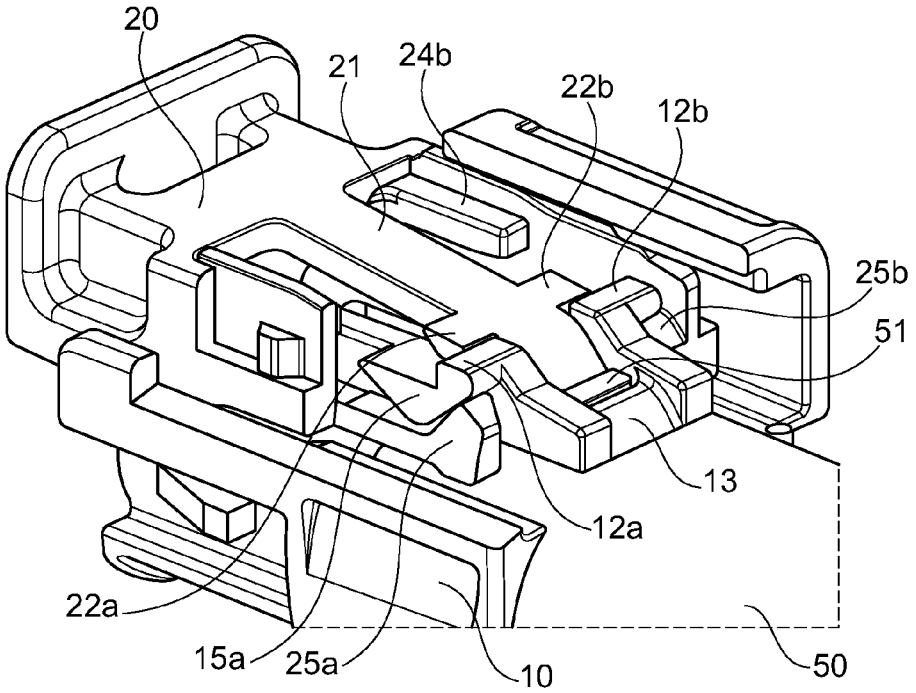
FIG. 8 illustrates a partially cut view of the assembly of FIG. 6 in another configuration according to one embodiment.

FIG. 8 illustrates the plug connector of FIG. 7 mated with the counter connector 50 but before the secondary locking device 20 is in the open or initial position. As can be seen, the jamming portion 24*b* is not covering the jamming surface 14*b* of the flexible leg 11*b* of connector housing 10 any longer. In addition, the T-shaped portions 22*a*, 22*b* are again on the outer side of projections 12*a*, 12*b* and the secondary locking function is disengaged. Furthermore, the release portion 25*a* is now in contact with unlocking portion 15*a* provided on flexible leg 11*b* of the connector housing 10. When the secondary locking device 20 is further removed from the connector housing 10, the release portion 25*a* interacts with unlocking portion 15*a* such that the flexible legs 11*a*, 11*b* of connector housing 10 are flexed. Since the jamming portions 24*b* are not covering the jamming surfaces 14*a*, 14*b* any longer, this flexing is not blocked. Preferably, the release portion 25*a* and/or the unlocking portion 15*a* is provided in form of a ramp, as illustrated, such that both portions can be in force-fitted contact with each other, allowing for a flexing of the flexible legs 11*a*, 11*b* without having to apply large forces.

Figure 9:
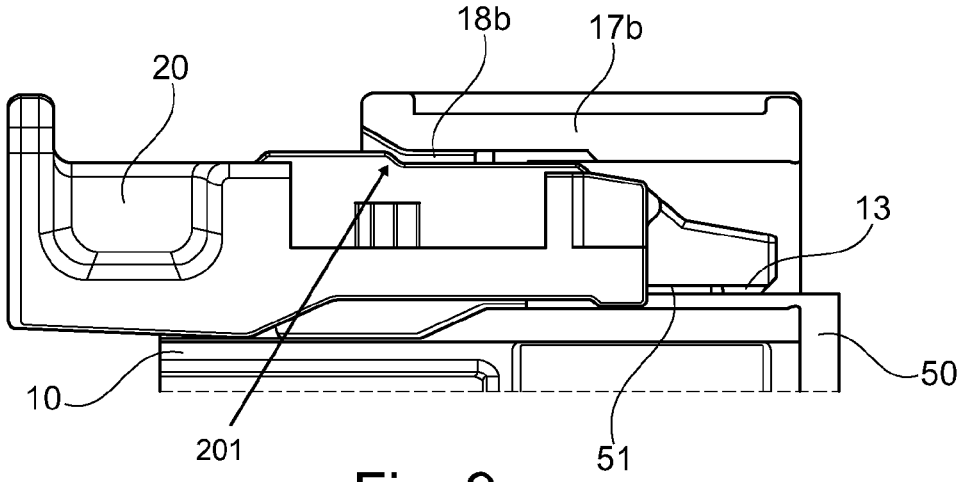
FIGS. 9 through 11 illustrate partially cut side views of a plug connector according to the present invention according to one embodiment.
Figure 10:
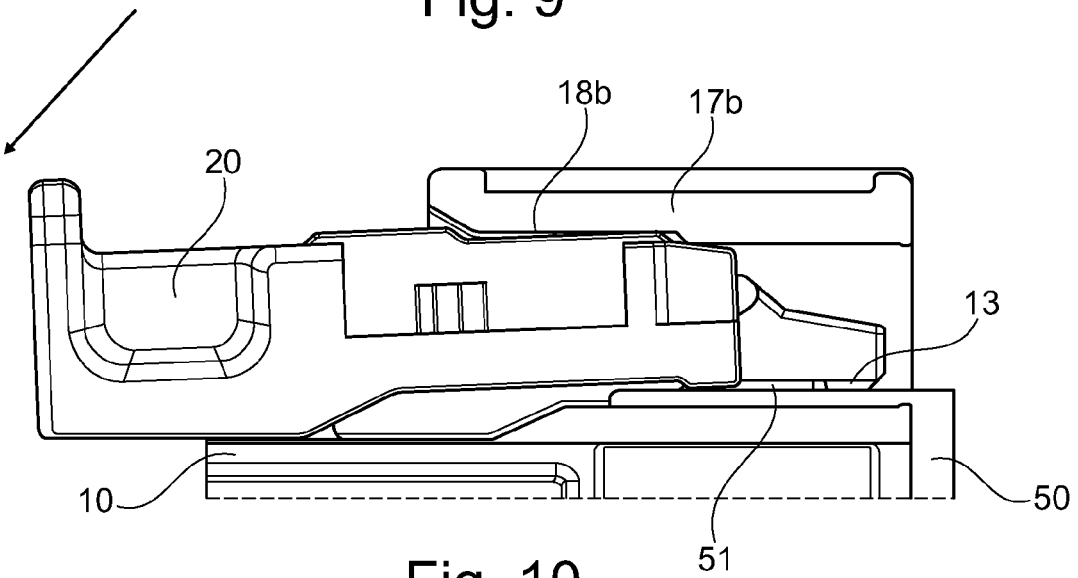

In a further preferred embodiment, as illustrated in FIG. 9, the guiding means 17*b* of connector housing 10 comprises a recess 18*b*, alternatively characterized as a gap, and the corresponding wall of the secondary locking device 20 comprises a step 201. The recess 18*b* is provided such that when the secondary locking device 20 is not in the closed position, it can be rotated such that the recess 18*b* receives the secondary locking device 20 at least partially. This configuration is illustrated in FIG. 10. The step 201 allows the rotation only when the secondary locking device 20 is pulled into the position of FIGS. 9 and 10, where the secondary locking device 20 is pulled further outwards away from the initial or open position shown in e.g. FIG. 8. Due to this rotary or angled motion, and due to the simultaneous contact of unlocking portion 15*a* with release portion 25*a*, the flexible leg 11*a*, 11*b* of connector housing 10 can be flexed by pushing onto the outer end of secondary locking device 20 as indicated by the arrow in FIG. 10. This movement is particularly ergonomic for the user. The secondary locking device 20 is thus used as a lever facilitating the unmating process. Due to this flexing motion, the primary locking device 13 is released from the respective counter-locking means 51 provided on counter connector 50 such that the plug connector can be removed from the counter connector 50 with minimal effort.

Figure 11:
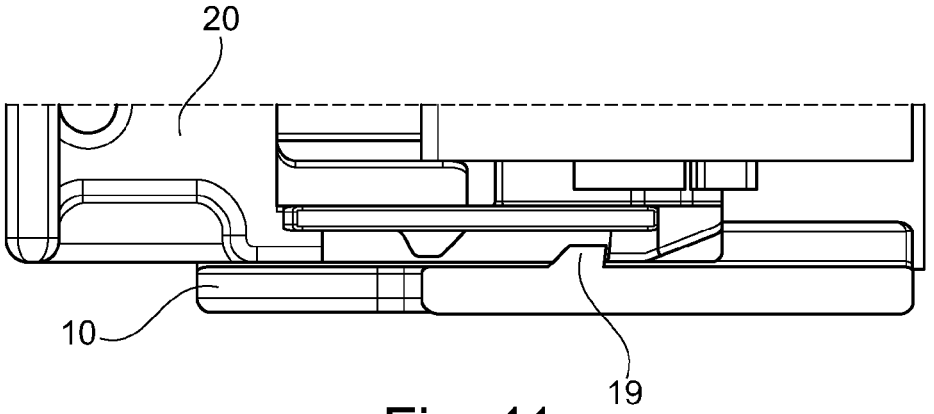

The depth of the recess 18*b*, which can receive the secondary locking device 20 at least partially, is in the range of 0.1 to 2.5 millimeters (mm), preferably in the range of 0.3 to 2.0 mm, more preferably in the range of 0.3 to 1.5 mm and most preferred in the range of 0.4 to 0.6 mm. With reference to FIG. 11, the connector housing 10 can comprise one or more hooks 19 which are adapted to interact with the secondary locking device 20 such that it cannot be fully removed from the connector housing 10.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LIST OF REFERENCE NUMERALS

10 connector housing
11*a*, 11*b* flexible leg
12*a*, 12*b* projection
13 primary locking device
14*a*, 14*b* jamming surface
15*a* unlocking portion
16*b* retention means
17*b* guiding means
18*b* recess or gap
19 hook
20 secondary locking device
21 flexible arm
22*a*, 22*b* T-shaped portion
23 secondary locking means
24*b* jamming portion
25*a*, 25*b* release portion
26*a* protrusion
27*a* feedback portion
28 actuation portion
29 actuation surface
30 terminal position assurance member
40 sealing member
50 counter connector
51 counter-locking means
201 step

The invention claimed is:

1. An electrical connector assembly having a plug connector, said electrical connector assembly comprising:

a connector housing having a flexible leg with a primary locking device configured to provide a primary locking function when the plug connector is mated with a corresponding counter connector, wherein the primary locking function can be disengaged when said flexible leg is flexed; and a secondary locking device being arranged movable relative to the connector housing between an open position and a closed position, said secondary locking device having a flexible arm and a jamming portion, wherein the flexible leg of the connector housing and the flexible arm of the secondary locking device are configured to be in blocking contact when said flexible arm is not flexed, so as to inhibit movement of the secondary locking device from the open position into the closed position, wherein the flexible arm of the secondary locking device is configured to be flexed when the plug connector is mated with the corresponding counter connector such that the secondary locking device can be moved into the closed position, and wherein the jamming portion of the secondary locking device is configured to prevent flexing of said flexible leg when the secondary locking device is in the closed position.

2. The electrical connector assembly according to claim 1, wherein the jamming portion of the secondary locking device is an element distinct from the flexible arm.

3. The electrical connector assembly according to claim 1, wherein the jamming portion of the secondary locking device does not engage the flexible leg of the connector housing when the secondary locking device is in the open position and said jamming portion at least partially covers the flexible leg of the connector housing when the secondary locking device is moved from the open position to the closed position so as to prevent a flexing of said flexible leg.

4. The electrical connector assembly according to claim 1, wherein a direction of movement of the secondary locking device from the open to the closed position is the same as a mating direction of the plug connector with the corresponding counter connector.

5. The electrical connector assembly according to claim 1, wherein the plug connector can be fully coupled to the corresponding counter connector by an inertial locking means.

6. The electrical connector assembly according to claim 1, wherein the flexible arm of the secondary locking device comprises a T-shaped portion, wherein the flexible leg of the connector housing comprises a projection, and wherein said T-shaped portion and said projection are in blocking contact when said flexible arm is not flexed, so as to inhibit the movement of the secondary locking device from the open position into the closed position.

7. The electrical connector assembly according to claim 6, wherein the flexible arm of the secondary locking device is configured to transfer forces acting in mating direction onto the secondary locking device along said flexible arm via the T-shaped portion onto the connector housing in a longitudinal direction thereof when the plug connector is not mated with the corresponding counter connector so as to inhibit the movement of the secondary locking device from the open position into the closed position.

8. The electrical connector assembly according to claim 4, wherein the connector housing (10) comprises a guiding means configured to guide the movement of the secondary locking device between the open position and the closed position such that the direction of movement is the same as the mating direction of the plug connector to the corresponding counter connector, wherein the guiding means comprises a recess such that the secondary locking device can be rotated at least partially around an axis perpendicular to the mating direction so as to flex the flexible leg of the connector housing when the secondary locking device is rotated.

9. The electrical connector assembly according to claim 8, wherein the secondary locking device cannot be rotated when the secondary locking device is in the closed position.

10. The electrical connector assembly according to claim 8, wherein the recess is configured to receive a part of the secondary locking device when the secondary locking device is rotated and wherein the recess has a depth in a range of 0.3 to 2.0 mm.

11. The electrical connector assembly according to claim 1, wherein the connector housing comprises a retention means configured to engage the secondary locking device in the open position and in the closed position so as to constrain the movement of the secondary locking device between the open position and the closed position.

12. The electrical connector assembly according to claim 11, wherein the secondary locking device comprises at least one protrusion configured to interact with the retention means of the connector housing in the open position and in the closed position.

* * * * *